United States Patent [19]

Taylor

[11] Patent Number: 5,036,447

[45] Date of Patent: Jul. 30, 1991

[54] LIGHT STAKE

[75] Inventor: Beverly W. Taylor, Hermann, Mo.

[73] Assignee: Handi-Pac, Inc., Hermann, Mo.

[21] Appl. No.: 545,570

[22] Filed: Jun. 29, 1990

[51] Int. Cl.[5] ..... F21V 21/00

[52] U.S. Cl. ..... 362/431; 362/249; 362/250; 248/51; 248/156

[58] Field of Search ..... 362/153, 227, 249, 250, 362/382, 387, 431; 248/51, 156

[56] References Cited

U.S. PATENT DOCUMENTS

| | | | |
|---|---|---|---|
| D. 282,164 | 1/1986 | Taylor | D25/77 |
| 2,292,140 | 8/1942 | Lofgren | 248/51 |
| 2,714,652 | 8/1955 | Meyer | 362/249 |
| 2,797,310 | 6/1957 | Moore | 362/431 |
| 3,275,818 | 9/1966 | Campbell | 362/249 |
| 4,404,621 | 9/1983 | Mauro | 362/250 |

*Primary Examiner*—Ira S. Lazarus
*Assistant Examiner*—Richard R. Cole
*Attorney, Agent, or Firm*—Polster, Polster and Lucchesi

[57] ABSTRACT

A stake (1) supports an outdoor lighting fixture. The light fixture includes a socket (23) for a light bulb (6), and electrical wires (w) connected to the socket. The stake has a stem (3) insertable into the ground. An improvement (7) comprises a housing 4 having an opening (9) in its upper end. The height of the housing is such that the socket fits within the housing when the fixture is installed on the stake. The light bulb protrudes through the opening in the upper end of the housing when the socket is so installed. One side of the housing has an opening (21) to allow insertion and removal of the socket. The housing has horizontal slots (29, 31) in its respective side walls to support the wiring for the fixture.

12 Claims, 2 Drawing Sheets

LIGHT STAKE

BACKGROUND OF THE INVENTION

This invention relates to outdoor lighting displays and more particularly to an improvement for stakes used to support lighting fixture for such displays.

U.S. Pat. No. DES. 282,104 and copending design patent application Ser. No. 07/543,731 pending which are owned by the same assignee as the current application, is directed to a stake for supporting an outdoor lighting fixture such as a Christmas light. While the patent references Christmas lights, in actuality, the stake can be used throughout the year for supporting outdoor lighting fixtures. Thus, in addition to its use in creating lighting effects during Christmas time, it can also be used to illuminate patios in the summertime, or walkways and driveways the year round. The stake shown in design patent DES. 282,104 is particularly for use with a large type lighting fixture having a bulb and bulb holder and supports a bulb 8"-12" above the ground. The bulb holder includes an L-shaped bracket having a leg sized to fit in a rectangular opening in the upper face of the light support portion of the stake. Typically, such bulbs are strung together with the wiring for the bulbs entering the base of the socket into which a bulb is screwed. Because each fixture in the string has a bracket fitting in the support portion of the stake, the fixtures are adequately supported as is the wiring running between fixtures.

There are other types of light fixtures used for outdoor lighting which do not include the bracket referred to above. The bulbs used in these fixtures tend to be smaller than those used shown in the Des. 282,104 patent and usually have no bracket at all. Such a string of the fixtures may simply consist of a series of light sockets joined together by wiring running between the base of the sockets. Two problems are therefore presented: first, how to support the light fixture on the stake; and second, how to support the wiring. One way would be simply to wrap the wiring around the side of the fixture and let the bulb dangle. Or, the bulb could be taped to the side of the stake. While either approach would serve to attach a light fixture to a stake, neither is aesthetically pleasing.

SUMMARY OF THE INVENTION

Among the several objects of the present invention may be noted the improvement to a stake for supporting outdoor lights such as Christmas lights; the provision of such improvement which allows the stake properly and securely to support either single light fixtures or one fixture in a string of lights; the provision of such improvement to also support the wiring for the light fixture; and the provision of such improvement in which the light fixture is easy to install and remove from the stake.

Briefly, the improvement of the present invention is in a stake for supporting an outdoor lighting fixture. The light fixture includes a socket for a light bulb and electrical wiring is connected to the socket. The stake has a stem, one end of which is insertable into the ground and a light fixture support attached to the other end. The improvement comprises an elongate housing at the other end of the stake, the housing having an opening in its upper end. The height of the housing is such that a socket fits within the housing when the fixture is installed on the stake. A light bulb screwed into the socket protrudes through the opening in the upper end of the housing when installed. One side of the housing has an opening to allow insertion and removal of the socket, and a horizontal slot is provided on at least one side of the housing to support the wiring for the fixture.

Other objects and features will be in part apparent and in part pointed out hereinafter.

BRIEF DESCRIPTION OF THE DRAWINGS

Corresponding reference characters represent corresponding parts throughout the several views of the drawings.

DESCRIPTION OF THE PREFERRED EMBODIMENTS

Figure 1A:
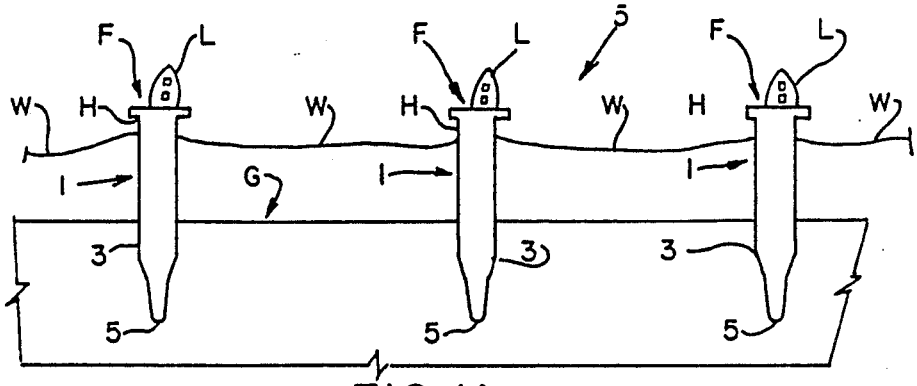
FIGS. 1A and 1B represent respective series of light stakes of the present invention used with a string of lights, FIG. 1A illustrating one embodiment of a light stake and FIG. 1B a second embodiment of the light stake.

Referring to the drawings, a stake 1 for use in an outdoor lighting display is indicated generally in FIG. 1A. As shown in FIG. 1A, a series of such stakes 1 are used with a string S of lights L. Each of the stakes in this embodiment has a stem 3, cruciform in transverse cross-section, which is driven into the ground G, the tip 5 of the stem being pointed for this purpose. Each stake also has a housing H for receiving a light fixture F of the string. Each fixture in the string is electrically connected by a wire W. Typically the light fixtures comprising the string are spaced apart equidistantly and, as shown in FIG. 1, the spacing between stakes 1 corresponds to the spacing between fixtures.

Figure 1B:
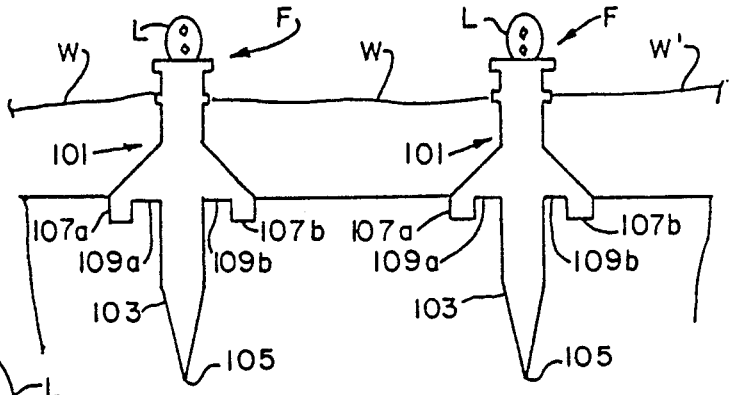
Figure 2B:
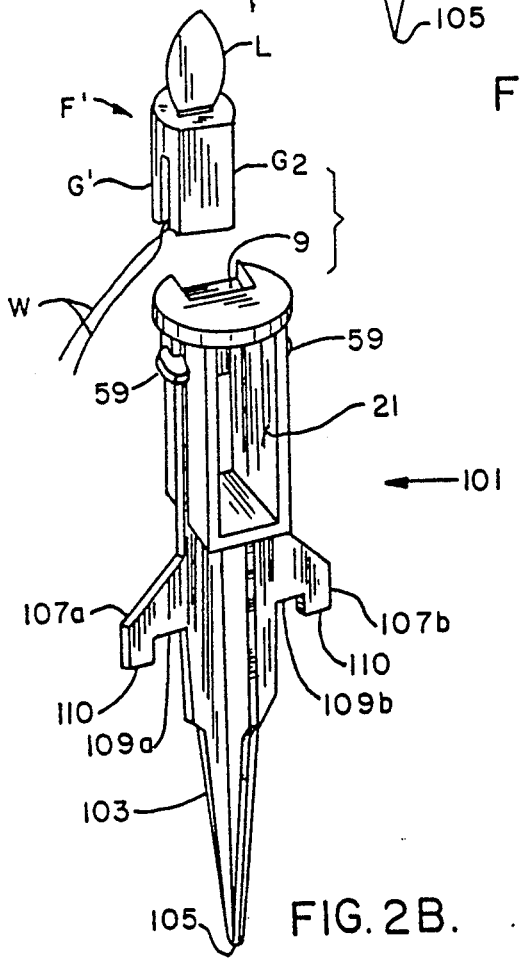
FIG. 2A is a perspective view of a prior art light stake and a light fixture with which the stake is used and FIG. 2B is a perspective view of a second type light stake and a light fixture with which the stake is used.

Similarly, in FIGS. 1B and 2B, a stake 101 is also for use in an outdoor lighting display. Stake 101 is similar to stake 1 in that it has a stem 103 by which the stake can be driven into the ground. The stem has a pointed tip 105 for this purpose. Stake 101 differs from stake 1 in having opposed, outwardly flaring arms 107A, 107B. The arms are useful as depth gauges in helping determine how far the light stake is driven into the ground. In the illustrative embodiment shown in FIG. 1B, each arm has an upwardly extending notch 109A, 109B respectively, in its lower face, defined by an outer edge of a rib of the stem of the stake and a finger 110. If a series of light stakes are each driven into the ground until the upper end of the notches is flush with the surface of the ground, the height of each light fixture above the ground will be uniform. Each stake has a housing for receiving the light fixture F of a string of lights. Light stake 101 is also shown in copending U.S. design patent application, Ser. No. which is assigned to the same assignee as the present application.

Figure 2A:
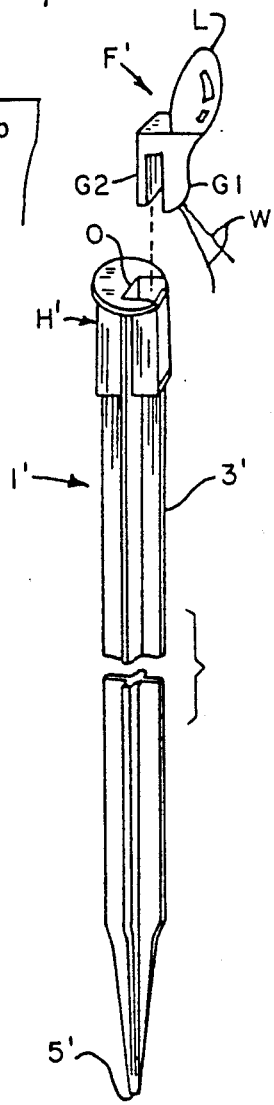
PRIOR ART FIG. 2A.
Figure 3A:
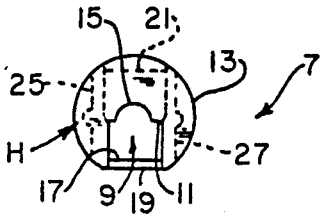
FIGS. 3A-3D represent a first fixture attaching embodiment of an improvement of the present invention.
Figure 3B:
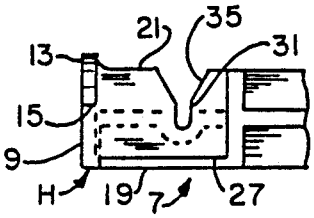
Figure 3C:
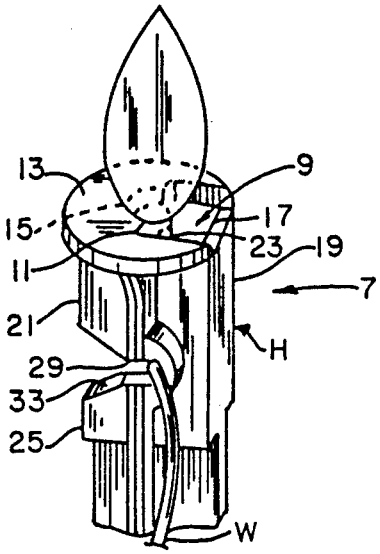
Figure 3D:
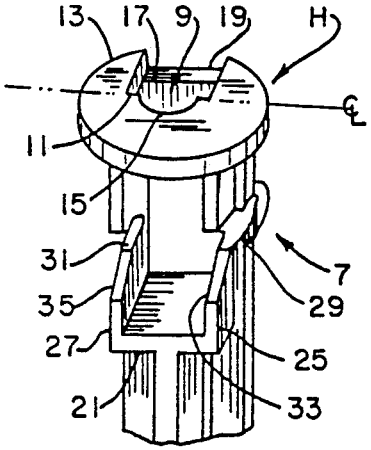

Referring to FIG. 2A, a prior art stake 1′ is shown. This stake is disclosed in U.S. Pat. No. Des. 282,104 and is assigned to the same assignee as the present application. This stake has a stem 3′ with a pointed tip 5′. At the upper end of the stake is a housing h′ which is hollow and has a rectangular slotted opening O in its upper end. This stake is useful with a light fixture F′. This fixture has an inverted U shape with legs G1 and G2. Leg G1 has a socket in its upper end into which a light L is screwed. The other leg G2 of the fixture fits into the housing through opening O to capture the fixture in the housing. The wires W for the fixture come into the bottom of leg G1 and are attached to the socket internally of the leg.

While the stake 1′ works well with fixtures of this type, other light fixtures do not have the U-shape shown in FIG. and the improvement of the present invention provides a stake where housing H can accommodate other light fixtures.

Referring to FIG. 3, an improvement to stakes 1 and 101 is indicated generally as 7 and includes an elongate housing H which is hollow and which is open at its upper end. This opening is a rectangular opening 9 one side 11 of which extends approximately along the transverse centerline CL of the top surface 13 of the housing in which the opening is formed. A semicircular notch 15 is formed in this side of the opening, the notch being centered about the mid-point of the side. The front edge 17 of opening 9 is opposite side 11 and adjacent front face 19 of the housing. The rear side 21 of the housing is open for installation of a light socket 23 into the housing. Once the socket is so installed, a light L can be screwed into the top of the socket, through opening 9. The housing has side walls 25, 27 in which are formed respective horizontal slots 29, 31. The slots extend forward from the open rear end of the housing and each slot has an outwardly flaring opening 33, 35 at the end of the slot adjacent the open rear end. Wires W leading to and from the socket are set into these slots to hold them in place. Thus for a string S of lights, the wire W leading to the fixture is, for example, fitted into slot 29, while the wire leading from this fixture to the next fixture is fitted in slot 31.

Figure 4A:
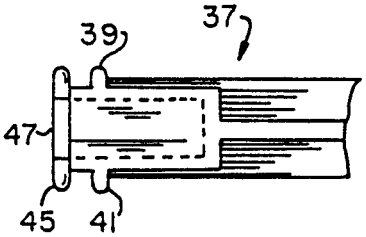
FIGS. 4A-4C represent a second fixture attaching embodiment of the improvement.
Figure 4B:
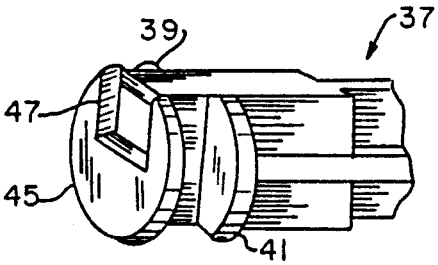
Figure 4C:
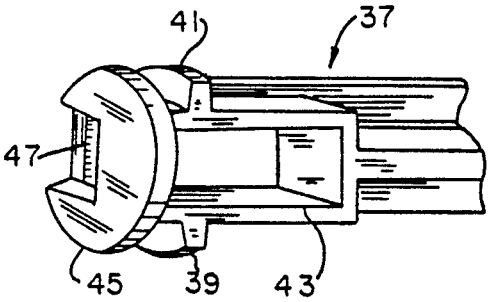

Referring to FIGS. 4*a*–4*c*, another housing embodiment comprising the improvement of the present invention is indicated generally as 37 and is similar in construction to that previously described. Now, however, instead of the slots 29, 31, the present embodiment includes respective horizontal shelves 39, 41 extending along the side walls of the housing. The shelves are for supporting wires W leading to and from the fixture. The housing has an open rear face 43 for a light socket to be installed in the housing. The top surface 45 of the housing has a rectangular opening 47 formed therein for a lamp to be installed in the socket.

Figure 5B:
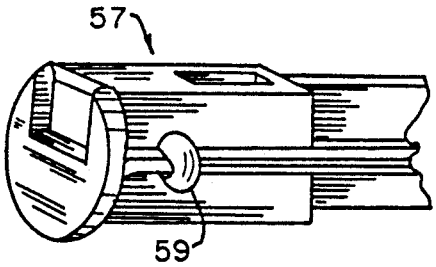
FIGS. 5*a* and 5*c* represent a third fixture attaching embodiment of the improvement.
Figure 5A:
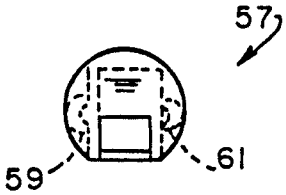

Referring to FIGS. 5*a* and 5*b*, a third embodiment of the improvement is indicated as 57. In this embodiment, the shelves are replaced by bumps or projections, 59 and 61 respectively, extending outwardly from the respective sides of the housing adjacent the open rear end of the housing. The function of the bumps is again to provide a support for wires leading to and from a socket installed in the housing.

Figure 6:
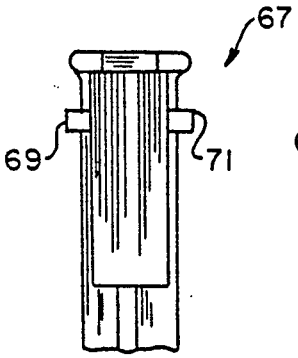
FIGS. 6 and 7 respectively represent fourth and fifth fixture attaching embodiments of the improvement.
Figure 7:
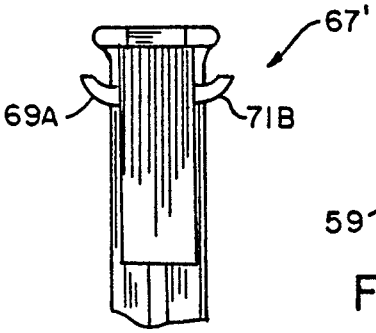

Lastly, FIGS. 6 and 7 illustrate further embodiments of the improvement indicated as 67 and 67′. Now, respective pins or posts 69 and 71 project outwardly from the sides of the housing. In FIG. 7, the pins are bent upwardly, as indicated at 69A and 71A, to facilitate support of the wires.

It will be appreciated that each of the above constructions can be incorporated equally as well into stake 1 or stake 101. As a result, the stakes could be used interchangeably with a string of lights to aesthetically and safely set up the string.

In view of the above, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense

What is claimed:

1. In a stake for supporting an outdoor lighting fixture, the light fixture including a socket for a light bulb and electrical wiring connected to the socket, and the stake having a stem one end of which is insertable into the ground and to the other end of which a light fixture support is attached, the improvement wherein the support comprises an elongate housing having an opening in its upper end, the height of the housing being such that the socket fits within the housing when the fixture is installed on the stake, the light bulb protruding through the opening in the upper end of the housing when the socket is so installed, one side of the housing being open to allow insertion and removal of the socket, and the housing having means on at least one side thereof adjacent the open face to support the wiring for the fixture.

2. The improvement of claim 1 wherein the opening in the upper end of the housing is generally rectangular and a notch is formed intermediate the length of one side of the opening to accommodate the base of a light bulb when it is fitted into the socket.

3. The improvement of claim 2 wherein the opening is offset to one side of the upper end of the housing whereby one side of the opening extends approximately along a centerline of the upper end and the notch is a circular notch centered about the midpoint of said one side of the opening.

4. The improvement of claim 1 wherein the open side of the housing is the rear face thereof and the support means includes a horizontal slot extending along one side wall of the housing forwardly from the end of the sidewall adjacent the open rear face, the wiring for the light fixture being received in the slot when the socket is installed into the housing.

5. The improvement of claim 4 further including a second horizontal slot formed in the opposite side wall of the housing whereby a wire leading to the fixture is fitted in one slot and the wire going from the fixture is fitted into the other slot.

6. The improvement of claim 5 wherein the outer end of each slot flares outwardly to facilitate insertion of the wiring into the slots.

7. The improvement of claim 1 wherein the support means comprises a horizontal shelf extending along the side walls of the housing adjacent the side in which the opening is formed, the shelves supporting the wiring for the fixture when the socket is installed in the housing.

8. The improvement of claim 1 wherein the support means comprises a bump formed on each of two side walls of the housing adjacent the side in which the opening is formed, the bumps supporting the wiring for the fixture when the socket is installed in the housing.

9. The improvement of claim 1 wherein the support means comprises a pin extending outwardly from the side walls of the housing adjacent the side in which the opening is formed.

10. The improvement of claim 9 wherein each pin is upwardly turned to help support the wiring.

11. The improvement of claim 1 wherein the stake further has opposed, outwardly flaring arms extending outwardly from the stem to determine the depth to which the stake is set into the ground whereby if a series of stakes are used to support a string of light bulbs, the bulbs will be at a generally uniform height above the ground.

12. The improvement of claim 11 wherein the said arms have downwardly depending fingers each defining, with an edge of a stem of said stake, an open bottomed, upwardly extending notch.

* * * * *